US005484053A

United States Patent [19]

Harris

[11] Patent Number: 5,484,053

[45] Date of Patent: Jan. 16, 1996

[54] BASKET-STYLE CLIP CARRIER

[75] Inventor: Randall L. Harris, Powder Springs, Ga.

[73] Assignee: Riverwood International Corporation, Atlanta, Ga.

[21] Appl. No.: 263,627

[22] Filed: Jun. 22, 1994

[51] Int. Cl.[6] ..... B65D 75/00

[52] U.S. Cl. ..... 206/147; 206/149; 206/162; 206/170; 206/180; 206/194; 206/429

[58] Field of Search ..... 206/147, 149, 206/162, 170, 174, 180, 193, 194, 427, 429; 294/87.2, 32

[56] References Cited

U.S. PATENT DOCUMENTS

| | | | |
|---|---|---|---|
| 2,299,625 | 10/1942 | Holmes | 294/87.2 |
| 2,330,699 | 9/1943 | Flamm | 206/147 |
| 2,896,814 | 7/1959 | Altenburg | 206/194 |
| 3,744,704 | 7/1973 | Struble | 206/194 |
| 3,868,140 | 2/1975 | Gordon | 206/427 |
| 4,155,502 | 5/1979 | Forte | 206/194 |

*Primary Examiner*—Paul T. Sewell
*Assistant Examiner*—Marie Denise Patterson

[57] ABSTRACT

A carrier with both a bottom panel and an upper panel containing openings through which the necks of packaged bottles extend. The upper panel is comprised of adjacent sections foldably connected to a central handle panel and to an intermediate panel. The latter panel also contains bottle openings and is foldably connected to a central vertical support panel. The arrangement permits loading by placing bottles on the bottom panel and pushing down on the handle panel, which causes the upper panel sections to pivot down over the bottles. Support tabs may surround the bottle openings in the upper panel to engage shoulders on the bottle necks.

7 Claims, 2 Drawing Sheets

BASKET-STYLE CLIP CARRIER

FIELD OF THE INVENTION

This invention relates to bottle carriers of the type that support packaged bottles by the underside of the bottle flanges. More particularly, it relates to carriers of this type which include additional structure for supporting the bottom of the bottles.

BACKGROUND OF THE INVENTION

Basket-style carriers have been used for many years to package bottles. Basically, they consist of bottom, side and end panels and one or more vertical supports to which a handle is connected. Divider partitions or straps extend out from the vertical supports to the side panels to form cells containing individual bottles. The bottles are supported by the bottom panel of the carrier and are prevented from contacting each other and moving out of the carrier by the cell structure. The carriers are sturdy and easy to lift and carry. One drawback, however, is their relatively high cost resulting from the amount of stock required to produce a carrier blank. Another drawback is that they allow only the upper portions of the bottles to be seen. For products whose containers are distinctive and readily identifiable, it may be preferred to expose substantially the entire bottle.

Bottles supported in clip-type carriers are exposed throughout their length due to the abbreviated height of the carrier. These carriers support the bottles from the underside of the bottle flanges. One such arrangement is a bottle neck carrier that employs so-called starburst support tabs surrounding the bottle neck openings in a support panel so as to engage the underside of the flange or shoulder that projects out from the bottle neck. Such carriers, however, are not perceived as holding the bottles in place as securely as basket-style carriers inasmuch as the individual bottles are apt to rotate or swing from their neck supports while the package is being carried.

It is an object of the invention to provide a basket-style carrier which exposes substantially the full height of the bottles to view while retaining the benefits normally associated with a basket-style carrier.

BRIEF SUMMARY OF THE INVENTION

The carrier of the invention includes adjacent upper panel sections which contain openings for receiving the necks of bottles. A central vertical panel connected to a bottom panel is connected along fold lines to two outwardly extending intermediate panels. Each intermediate panel also contains bottle neck openings and is connected along a fold line at one end to the central panel and along a fold line at the opposite end to the outer edge of an upper panel section. Preferably, support tabs are foldably connected to the periphery of the bottle neck openings in the upper panel sections so as to support the bottles by engaging shoulders on the bottle necks.

This arrangement results in dual support structure which supports both the bottoms and the shoulders of bottles packaged in the carrier. The sides of the carrier are open, allowing the bottles to be visible, and the design lends itself to the use of a centrally located basket-type handle for lifting and carrying the package. In addition, the carrier is especially easy to set up and load, an operation which allows the carrier to be automatically formed about the bottles as a result of a single movement of the handle panel. Also, the packages can be stacked for shipping.

The features which enable the carrier to provide these functions are brought out in more detail in connection with the description of the preferred embodiment, wherein the above and other aspects of the invention, as well as other benefits, will readily become apparent.

DETAILED DESCRIPTION OF THE PREFERRED EMBODIMENTS

Figure 1:
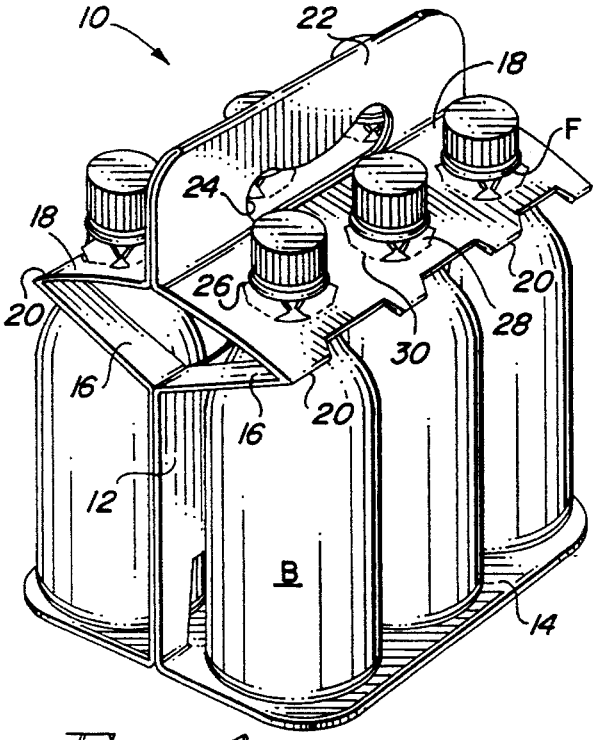
FIG. 1 is a pictorial view of a carrier embodying the features of the invention.

Referring to FIG. 1, a carrier designed to carry two rows of three bottles B is indicated generally at 10. The carrier comprises a centrally located vertical support panel 12 extending up from a bottom panel 14. Extending out from the upper edge of the support panel 12 are spaced parallel straps 16 which are connected to upper panel sections 18 by spaced fold lines 20. The outer edge portions of the upper panel sections 18, the vertical support panel 12 and the straps 16 define cells which encircle the bottle necks. Extending up from the inner edge of each upper panel section 18 is a centrally located handle panel 22 containing a handle opening 24. Included in the upper support panel sections are openings 26 through which the necks of the bottles extend. The end edges of tabs 28, which are connected to the panel sections 18 by fold lines 30 extending about the periphery of the bottle neck openings 26, contact the underside of flanges F on the bottles to partially support the bottles when the carrier is lifted. Because the bottles are also partially supported by the bottom panels 14 the carrier readily supports the weight of the bottles. The cell structure assists in maintaining bottles in place against transverse movement and, together with the bottom panel, prevents them from swinging or rotating while the carrier is lifted and carried. As explained below, the structure of the carrier also allows the bottles to be stacked on a pallet for shipping and handling.

Figure 2:
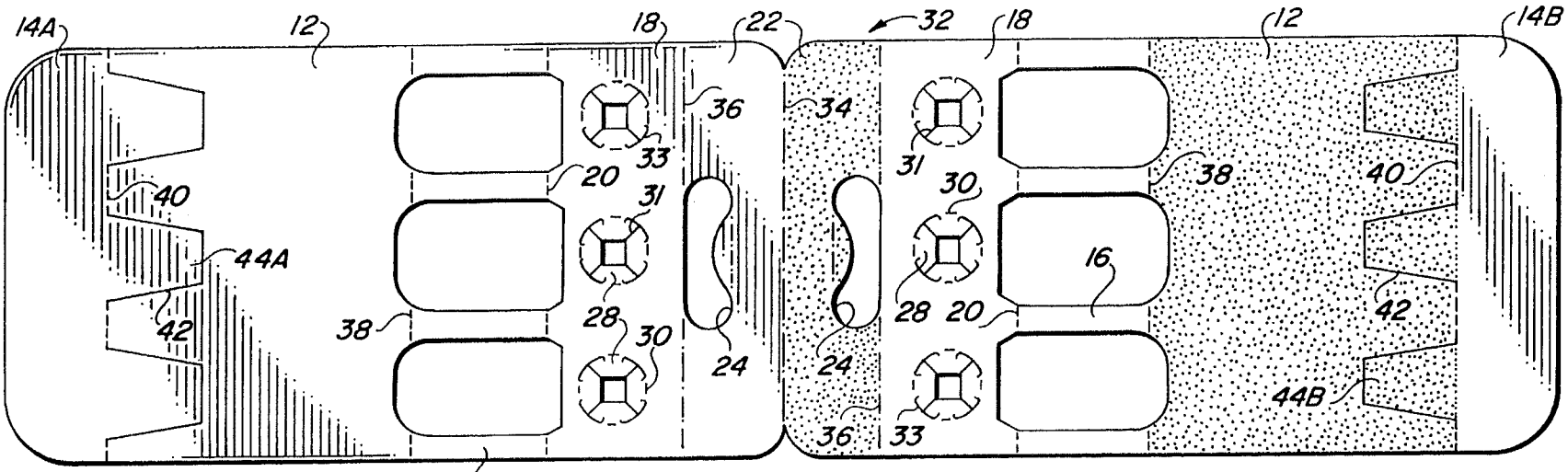
FIG. 2 is a plan view of a blank for forming the carrier of FIG. 1.

Referring to FIG. 2, wherein like reference numerals to those used in FIG. 1 denote like elements, a blank 32 for forming the carrier is shown as comprising a substantially rectangular sheet. It is preferably formed of paperboard, but may be of any suitable material having sufficient strength and flexibility to function in the manner of paperboard. The blank consists of substantially identical halves connected to each other along central fold line 34, each half comprising a handle panel section 22, an upper panel section 18, spaced divider straps 16, a vertical support panel section 12 and a bottom panel section 14. Each upper panel section 18 is connected to the adjacent handle panel section 22 by fold line 36. In the illustrated design the fold line 36 is interrupted by the edge of the handle opening 24, but it will be understood that the opening could be spaced from the fold line if desired. The slight difference between each half of the blank is explained below.

As is conventional, the diameter of the bottle openings 26 in the upper panels 18 is related to the diameter of the neck portion of the bottles to be packaged so that the shoulder or flange of the bottle neck is able to pass through the opening while contacting the support tabs 28 to pivot them up about their fold lines 30. The support tabs 28 comprise four contiguous tabs arranged so that the fold lines 30 of adjacent tabs are at right angles to each other. Slits 31, extending at 45° to the adjacent tab fold lines, separate the tabs and arcuate slits 33 separate the tab fold lines.

The inner ends of the divider straps 16 are connected to the upper panel sections 18 by interrupted fold lines 20, and the other ends are connected to the vertical support panel sections 12 by fold lines 38. The cutout areas between the straps 16 and the upper and vertical support panel sections 18 and 12, respectively, form the cell openings in a carrier formed from the blank. An interrupted fold line 40 connects each bottom panel section 14 to the adjacent vertical support panel section 12, with slits 42 extending from the ends of the fold line segments to form glue fingers 44. For better clarity in explaining the folding steps to be followed in forming a carrier, the bottom panel section and glue fingers at the left side of the blank have been designated 14A and 44A, respectively, while the bottom panel section and glue fingers at the right side have been designated 14B and 44B, respectively. Although not discernible in FIG. 2, the glue fingers 44A are slightly larger than the glue fingers 44B as explained more fully below.

Figure 6:
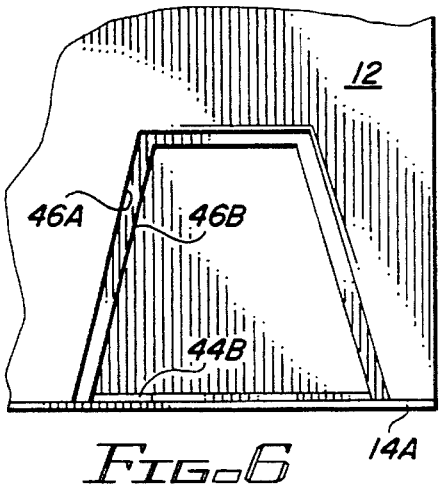
FIG. 6 is an enlarged partial side view of the erected carrier, illustrating the difference in size of the openings in the two plies of the vertical support panel of the carrier.
Figure 5:
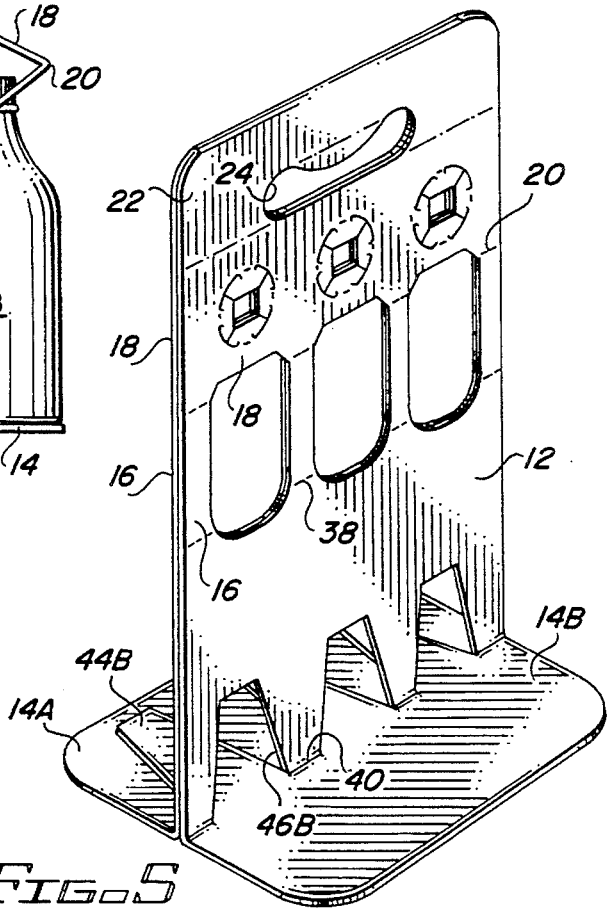
FIG. 5 is a pictorial view of the erected carrier.
Figure 4:
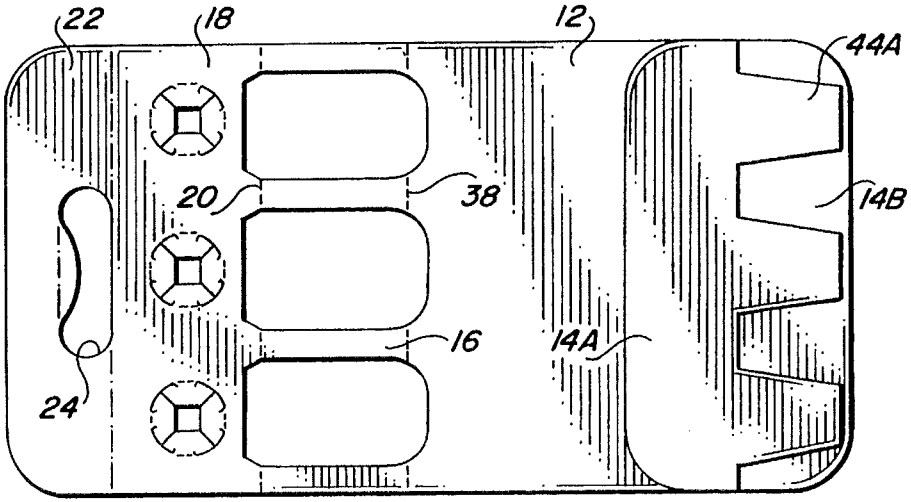
FIG. 4 is a plan view of the blank of FIG. 2, illustrating the final folding and gluing step.
Figure 3:
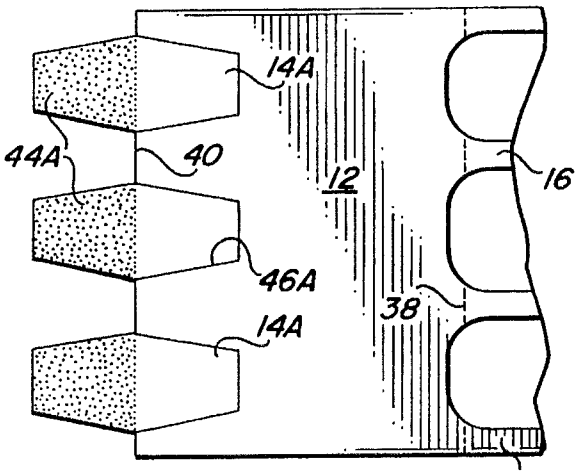
FIG. 3 is a partial plan view of the blank of FIG. 2, illustrating an initial folding step.

To form a carrier, the blank must be erected to an interim condition, which is initiated by first folding one of the bottom panel sections under the blank. This is illustrated in FIG. 3, wherein the bottom panel section 14A has been folded about the fold line 40 so that it is underneath the rest of the blank and the glue fingers 44A extend out from the end of the blank. When the bottom panel section 14A is folded under, the areas between the slits 42 which previously had been occupied by the glue fingers 44A become openings or cutouts 46A. Thus the face of the bottom panel section 14A and the glue fingers 44A visible in FIG. 3 was the underside of this section and its glue fingers prior to this folding step. Glue is then applied to the areas in stipple of both FIG. 2 and FIG. 3, and the blank is folded about fold line 34. The handle panel sections 22 are thus glued together, as are the vertical support panel sections 12. The resulting collapsed blank is illustrated in FIG. 4. It will be seen that the fingers 44A are now adhered to the bottom panel section 14B and it will be understood that the fingers 44B are adhered to the bottom panel section 14A. Then, by folding the bottom panel section 14A down about its fold line 40 and the bottom panel section 14B up about its fold line 40 the bottom panel sections are caused to extend out from the combined vertical support sections 12 at right angles to the erected condition illustrated in FIG. 5. The upper panel sections 18 are slightly separated from each other, as they have not been glued together. The same is true for the divider straps 16. The folding of the bottom panel section 14B moves the fingers 44B down out of the plane of the associated support panel section 12, creating openings or cutouts 46B. The fingers 44B pass through the openings 46A as they move to the erected condition of the carrier shown in FIG. 5. If the fingers 44B and the openings 46A were the same size the fingers 44B could snag on the edges of the openings and interfere with the carrier set-up. By making the fingers 44A slightly larger than the fingers 44B, the openings 46A are larger than the fingers 44B, thereby ensuring that there will be no interference by the edges of the openings 46A to movement of the fingers 44B. The difference in size is illustrated in FIG. 6.

Figure 7:
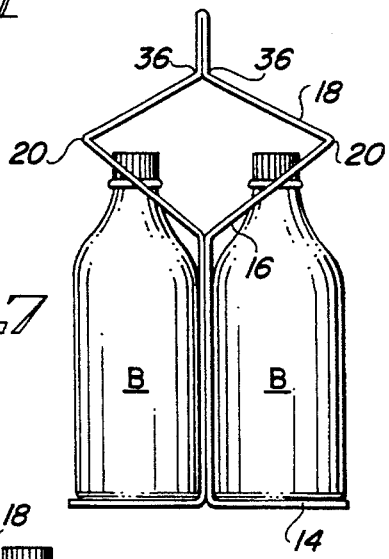
FIG. 7 is an end view of the erected carrier blank as it is being folded into final position after bottles have been placed on the bottom panel sections.

The carrier is loaded by placing bottles on the bottom panel sections and then pushing down on the handle panel 22. This movement causes opposite segments of the folds 20 to move away from each other as in a scissors movement, pivoting the upper panel sections 18 up about the fold lines 36 and the divider straps 16 down about the fold lines 38. An interim condition of the carrier during these pivoting movements is illustrated in FIG. 7. As this action continues the cells move down over the tops of the bottles and the bottle caps enter the openings 26. The bottle caps engage the support tabs 28, pivoting them up until the bottle flange moves past the ends of the tabs. The tabs then snap back toward their original position, engaging the underside of the bottle flanges. The condition of the carrier after the above steps have been completed is similar to the carrier of FIG. 1.

Figure 8:
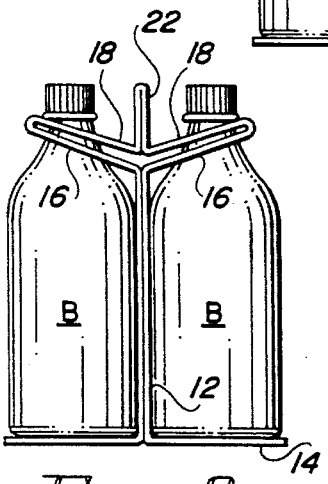
FIG. 8 is an end view of the carrier of FIG. 1, showing the handle in depressed position.

After the support tabs have moved beneath the bottle flanges, the handle panel can be pushed down still farther, moving the upper panel sections down until the greater diameter of the bottles at the transition areas between the bottle necks and the bottle barrels prevents additional downward movement. As shown in FIG. 8, the handle panel can thus be moved to a point where its upper edge is no higher than the tops of the bottles. This enables the carriers to be stacked on a pallet for shipping. The handle panels need not be individually pushed down for this to occur. The weight of a carrier being placed on top of another is sufficient to push the handle panel of the lower carrier down.

Although the bottles have been shown as having a separate integral flange, the terms "flange" or "shoulder" as used in the specification and claims are intended to include the underside of bottle caps in bottles which do not incorporate an integral flange.

It can now be appreciated that the invention provides a unique carrier which incorporates certain desirable features of a basket-style carrier and a bottle neck clip. The bottles are open to view, yet are tightly and securely held in place by the combined action of the support tabs and the bottom panel and are prevented from having transverse movement within the carrier by the structure of the cells. In addition, the bottom panel is strengthened by the glue fingers which form a two-ply thickness where they contact the opposite bottom panel section. Also, the carrier is easily and automatically formed about the bottles to be packaged by merely pushing the handle panel down after erecting the carrier blank, and as indicated, the carrier construction allows the handle panel to be moved down out of the way when stacking carriers for shipment. Although the carrier provides the benefits of a basket-style carrier, it is considerably less expensive than a basket-style carrier as a result of requiring much less stock to produce the blank. The carrier is also capable of running through a packaging machine at higher speeds than a conventional basket-style carrier.

It will be understood that the invention is not limited to all the specific details described in connection with the preferred embodiment, except as they may be within the scope of the appended claims. Changes to certain features of the preferred embodiment which do not alter the overall basic function and concept of the invention are therefore contemplated.

What is claimed is:

1. A substantially rectangular blank for forming a carrier for necked bottles, comprising:

two handle panel sections connected to each other along a central fold line;

an upper panel section connected to each handle panel section along a fold line substantially parallel to the central fold line, each upper panel section containing openings for receiving the necks of bottles;

an intermediate panel section connected to each upper panel section along a fold line substantially parallel to the central fold line, each intermediate panel section containing openings for receiving a neck of a bottle;

a central vertical panel section connected to each intermediate panel section along a fold line substantially parallel to the central fold line; and a bottom panel section connected to each central vertical panel section along a fold line substantially parallel to the central fold line;

the fold line connecting each bottom panel section to a central vertical panel section being interrupted by transversely extending slits forming glue fingers, the glue fingers associated with one of the bottom panel sections being larger than the glue fingers associated with the other bottom panel section.

2. A carrier blank as defined in claim 1, wherein each intermediate panel section is comprised of a plurality of spaced divider straps, the openings in the intermediate panels for receiving the necks of bottles being comprised of the spaces between adjacent divider straps.

3. A carrier blank as defined in claim 1, including a plurality of support tabs connected to the upper panel sections by fold lines extending along portions of the periphery of each bottle neck opening therein for engaging shoulders on the necks of bottles packaged in a carrier formed from the blank.

4. A carrier for necked bottles, comprising:

two upper panel sections having adjacent inner side edges and opposite outer side edges, the upper panel sections containing openings for receiving the necks of bottles;

a handle panel foldably connected to the inner side edges of the upper panel sections, the handle panel including a handle opening therein;

a bottom panel comprised of two half-panel sections;

a central vertical panel of two-ply construction, one of the plies being foldably connected to one of the half-panel sections of the bottom panel and the other ply being foldably connected to the other half-panel section of the bottom panel, each central panel ply extending upwardly from the associated bottom panel section, the central vertical panel and the handle panel lying in substantially the same plane;

the central panel plies having cutouts therein adjacent the bottom panel;

the bottom panel sections being adhered to each other by glue fingers formed from the cutouts in the central panel plies;

two intermediate panels extending outwardly from the central panel in opposite directions, each intermediate panel being connected along a fold line at one end thereof to one of the plies of the central panel and along a fold line at the opposite end thereof to the outer side edge of one of the upper panel sections; and each of the intermediate panels containing openings for receiving a neck of a bottle.

5. A carrier as defined in claim 4, wherein the glue fingers associated with one of the bottom panel sections are larger than the glue fingers associated with the other bottom panel section.

6. A carrier as defined in claim 4, wherein each intermediate panel is comprised of a plurality of spaced divider straps, the openings in the intermediate panels for receiving the necks of bottles being comprised of the spaces between adjacent divider straps.

7. A carrier as defined in claim 4, including a plurality of support tabs connected to the upper panel sections by fold lines extending along portions of the periphery of each bottle neck opening therein for engaging shoulders on the necks of bottles packaged in the carrier.

* * * * *